US007632223B2

(12) United States Patent
Alexiadis

(10) Patent No.: US 7,632,223 B2
(45) Date of Patent: Dec. 15, 2009

(54) PORTABLE WEIGHT BEARING POSTURAL CORRECTION DEVICE

(76) Inventor: Alkis Alexiadis, 2240 Sloane Pl., Wellington, FL (US) 33424

( * ) Notice: Subject to any disclaimer, the term of this patent is extended or adjusted under 35 U.S.C. 154(b) by 0 days.

(21) Appl. No.: 11/496,695

(22) Filed: Jul. 31, 2006

(65) Prior Publication Data

US 2007/0038162 A1 Feb. 15, 2007

Related U.S. Application Data

(60) Provisional application No. 60/704,269, filed on Aug. 1, 2005.

(51) Int. Cl.
*A63B 71/00* (2006.01)

(52) U.S. Cl. ..... 482/148; 601/5; 128/845

(58) Field of Classification Search ..... 482/79–80, 482/148, 142–143; 601/5, 24, 31–36, 29, 601/26, 23; 606/42, 237, 240–245; 128/845, 128/78; 280/47.19, 47.131; 5/81.1, 601, 5/626–630

See application file for complete search history.

(56) References Cited

U.S. PATENT DOCUMENTS 4,809,804 A * 3/1989 Houston et al. ..... 180/65.5
4,844,107 A 7/1989 Watkins
5,179,746 A * 1/1993 Rogers ..... 5/625
5,303,981 A 4/1994 Wilder et al.
6,353,949 B1 3/2002 Falbo
6,357,063 B1 * 3/2002 Selby ..... 5/81.1 R
6,679,554 B2 1/2004 Anders
6,685,658 B1 * 2/2004 Dietz et al. ..... 601/5
6,702,691 B2 * 3/2004 Gile et al. ..... 473/266
6,845,533 B1 * 1/2005 Tulette ..... 5/626
6,923,731 B2 * 8/2005 Erickson et al. ..... 473/266
2002/0123708 A1 9/2002 Dumm et al.
2003/0004444 A1 1/2003 Perner et al.
2004/0021353 A1 * 2/2004 Lozano et al. ..... 297/255

OTHER PUBLICATIONS

"Portable Adjustable Rehab Table and Standing Frame" found at www.physio2U.co.nz/shop/standingframe.php , 2004.
GTK Rehab found at www.e-bility.com/gtkrehab/products/des_sf4.php, Catalogue 2004, revision date Aug. 10, 2004.
"Econostand" found at www.stand-aid.com/standing_frames_power_standing_frames.htm, 2004.

* cited by examiner

*Primary Examiner*—Lori Amerson
(74) *Attorney, Agent, or Firm*—Dara L. Onofrio, Esq.; Onofrio Law

(57) ABSTRACT

A device to enable an individual the ability to stand in an upright position including a backboard component; a foot component; and at least one strap for securing the individual to the device; wherein the backboard component and the foot component are connected by an attachment means allowing the foot component to fold into the backboard permitting the device to be easily transported.

14 Claims, 10 Drawing Sheets

PORTABLE WEIGHT BEARING POSTURAL CORRECTION DEVICE

This application claims the benefit of U.S. provisional application No. 60/704,269 filed Aug. 1, 2005, which is incorporated herein in its entirety by reference.

FIELD OF THE INVENTION

The present invention relates to a portable weight bearing postural correction device used to enable individuals with postural deficiencies the ability to stand safely. In particular, a physically impaired or bedridden individual is strapped and secured at various points to the device to permit them to stand safely in an upright position unassisted for short periods of time.

BACKGROUND OF THE INVENTION

Many physically impaired, disabled or bedridden individuals use devices to assist them in standing safely so that they may perform day to day functions and improve the body's physiological functions. Some benefits that individuals experience from standing include an improved range of motion, decreased joint and muscle contractures, improved circulatory and respiratory functions, decreased muscle spasms, aid in normal skeletal development, improved bowel function, improved kidney and bladder function and maintenance of bone strength.

However, the devices which are used for standing, commonly referred to as standing aids or standing frames, are often quite bulky and heavy, thereby making them difficult to transport from one place to another.

U.S. Pat. No. 6,685,658 B1 to Dietz et al. describes an apparatus which actively moves the legs of a disabled person in a movement pattern that is similar to walking. This vertical "active standing table" can be adjusted between a horizontal and vertical position. Moreover, the individual is fixed to the table by means of a belt gear. The purpose of this rehabilitation device is to improve muscle tone and circulation. In addition to allowing one to practice "walking," this device allows for one to stand upright without the aid of another for a prolonged period of time.

U.S. Publication 2002/0123708 to Dumm et al. discloses a back stretching apparatus, capable of suspending a person comfortably in an upright position. The backboard is comprised of an inclined platform with footholds and a strap wrap. The strap is wrapped under the individual's arms, and across the individual's torso. The platform can be fixed to a wall or stand freely with the assistance of a support rack and a T-bar.

Both these devices are quite large and as a result, take up a lot of space and are difficult to store.

In addition, U.S. Publication 2003/0004444 A1, titled "Rehabilitation Device for Persons with Paresis of Lower Limbs Enabling them to Walk," by Perner et al.; U.S. Pat. No. 5,303,981, titled "Standing Aid for Use with a Checkout Counter," by Wilder et al.; U.S. Pat. No. 6,353,949 B1, titled "Tilt Table for Disease Diagnosis" by Falbo; U.S. Pat. No. 4,844,107 titled "Portable Standing and Seating Aid," by Watkins; and U.S. Pat. No. 6,679,554 B2 titled "Stand Aid," by Anders disclose various devices to aid the physically impaired.

A product named, "Portable Adjustable Rehab Table and Standing Frame" (found at www.physio2u.co.nz/shop/standingframe.php) is a light-weight, compact, adjustable and portable standing frame. The frame includes an aluminum base, rehab table and support strapping which may be customized. The benefits of standing for people with neurological challenges, is stated on the website. This product is currently a patent application No. 533402 in New Zealand and NZ Design Registration No. 404935.

A supine standing frame/tilt table which adjusts so that it may be used by children from 6 to 12 years of age is described at http://e-bility.com/gtkrehab/products/des_sf4.php.

The "Econostand" (found at www.stand-aid.com/standing_frames_power_standing_frames.htm) is a version of the standing frame which comes in a stationary hydraulic lift unit. Thus, a wheelchair bound person can get to a vertical standing position without the aid of another.

These products described above are operated using hydraulic or electrical energy which are cumbersome to use and costly to operate.

None of these devices provides a device which is also portable, compact and easily transported. An advantage of the present invention over these devices is in the provision of a device which is compact and portable and can be used easily. Moreover, the present invention is economically affordable for the consumer as compared to known devices.

A general objective of the invention is to provide a portable device used to enable individuals with postural deficiencies the ability to stand safely.

Another objective of the invention is to foster proper body mechanics to improve balance and enable ambulation.

Another objective of the invention is to increase calcium retention in the bones for that segment of the population that does not stand or walk around enough because they are unable to safely and independently stand or walk or because they do not have someone to guard them when they stand or walk.

Another object of the invention is to increase bone density for the eldery, disabled, and/or the population with osteoporosis, heart disease or other ailments.

Another object of the invention is to increase trunk extension of the body.

Another object of the invention is to increase an individual's ability to breathe more deeply, and thereby improve oxygenation to the body by extending the rib cage vertically and horizontally. As a result, the lungs are able to expand into a larger ribcage area and take in more oxygen.

Another object of the invention is to function as a postural corrector by producing counter and corrective forces for destructive postural syndromes such as rounded shoulders, forward bent heads and trunks.

Another object of the invention is to allow individuals who are not safe or good walkers to gain from the benefits of increased daily standing and to do so safely.

Another object of the invention is to foster normal gait mechanics by increasing calf, gastrocnemius, soleus and hamstring length.

Another object of the invention is to increase ankle, knee, hip and lower and upper back active range of motion.

Another object of the invention is to provide a foot component which is adjustable, thereby allowing differing tensions to be applied to the calf muscles, namely the gastrocnemius, soleus and hamstring muscles.

SUMMARY OF THE INVENTION

In the present invention, these purposes, as well as others which will be apparent, are achieved generally by providing a portable postural corrector device to enable individuals with postural deficiencies the ability to stand safely. It comprises a device having a backboard component, foot component and at least one strap for securing the individual to the device.

In particular, the backboard component and the footboard component are connected by an attachment means. The attachment means are preferably selected from the group consisting of hinges, spring action mechanism, rachet stops, welds, plates, screws, bolts, sliding or telescoping parts etc. This attachment means allows the foot component to be adjusted to the user's needs and to fold into the backboard component permitting the device to be compact and easily transported.

The device contains at least one side rod positioned along one side of the backboard component. An additional side rod is positioned along the opposite side of the backboard component.

The device may also contain a pair of arm supports which are adjustable and foldable into the backboard component for easy transport.

The device may also contain a pair of handles for transporting the device. Such handles may fold into the device for easy transport.

The bottom side of the device may comprise at least one pair of wheels.

The foot component of the device may further comprises a pair of anti-tilt feet which extend out from the bottom side of the foot component and easily fold into the foot component and prevent the device from forward tipping. In an alternate embodiment, the anti-tilt feet may extend out from the base of the backboard component to stabilize the device.

A strap is attached to one side rod and loops around the other side rod thereby securing the individual to the device. In another embodiment, a strap can be attached to each of the side rods. Moreover, the device can contain additional straps to further secure the individual to the device. In yet another embodiment the straps are secured directly to the backboard via stitching, rivets, bolts, hooks, hinges, etc.

The device may contain one or more support cushions positioned at various points along the device. In addition, in another embodiment the device may include a fold up seat.

In an alternate embodiment, the backboard component may comprise two segments which can either fold into each other or collapse/slide into each other.

The device can be either free standing or positioned against a wall or doorway.

In providing more stability, the device may further comprise an attachment element such as an adjustable strap with a hook or bulbous end to anchor the backboard component to a wall or door to prevent the device from tipping forward. The bulbous end would consist of a rubber or nylon ball, wedge, etc. and would be attached to the end of the strap.

Other objects, features and advantages of the present invention will be apparent when the detailed description of the preferred embodiments of the. invention are considered with reference to the drawings, which should be construed in an illustrative and not limiting sense.

BRIEF DESCRIPTION OF THE DRAWINGS

FIG. 2(*b*) is an illustration of one arm support with a strap; and FIG. 2(*c*) is an illustration of a person using the arm support.

FIG. 3(*b*) is an illustration showing straps attached to each side rod; and FIGS. 3(*c*) and 3(*d*) are illustrations of other embodiments of the invention device depicting variations in attachment of the strap.

FIG. 5(*b*) is a side view of another embodiment of the invention device which is free standing with the anti-tilt feet folded into the foot component.

FIG. 5(*c*) is a side view of another embodiment of the invention device with an attachment element to secure the invention device to a door or other support.

FIGS. 15(*b*) and 15(*c*) illustrate the locking mechanism of the wheels to secure the device in the position desired.

FIGS. 16(*d*) and 16(*e*) illustrate positioning of the handle component and folding, respectively.

DETAILED DESCRIPTION OF THE INVENTION

In accordance with the present invention a portable weight bearing postural correction device is provided to enable individuals with postural deficiencies the ability to stand safely.

Figure 1:
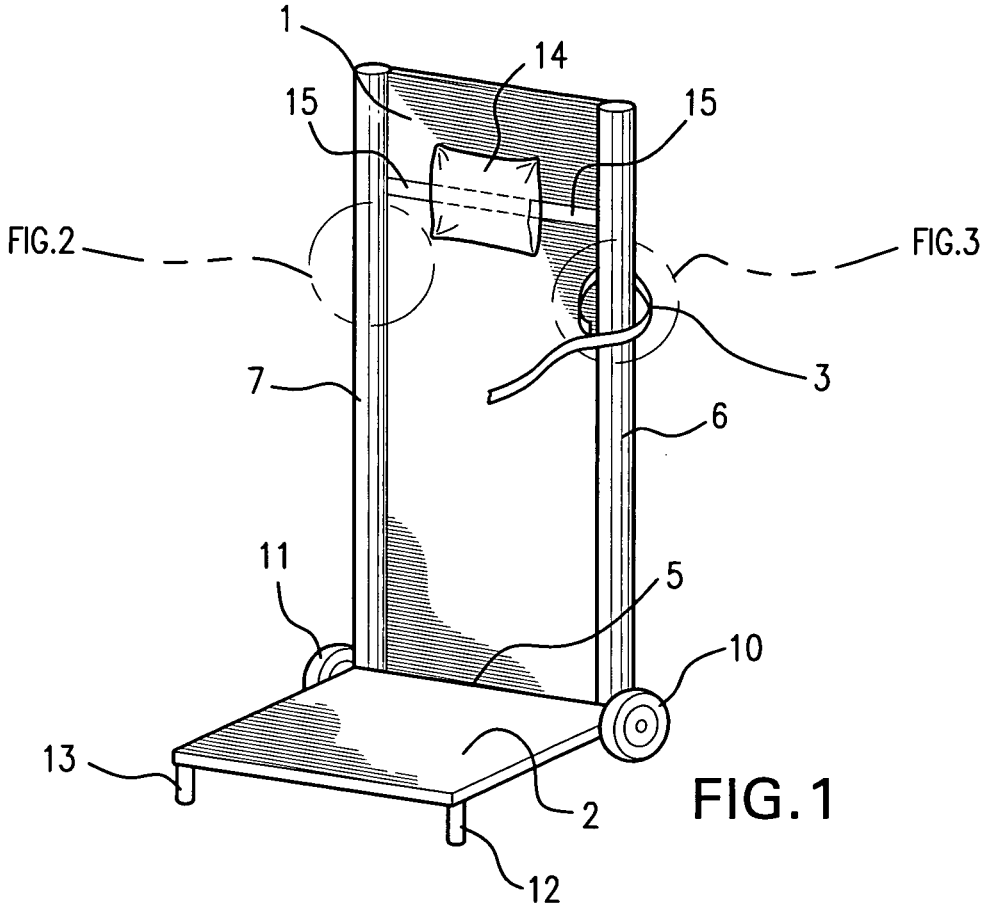
FIG. 1 is an illustration of the general features of the portable posture corrector device of the invention.

In general, FIG. 1 represents the invention device. In particular, the device is comprised of backboard component 1, foot component 2, and at least one strap 3. Additionally, side rods 6 and 7 are parallel to the backboard component and may run the complete length of the backboard. Moreover, the side rods may be incorporated into the back board itself in the form of cut-outs or grooves.

Figure 2A:
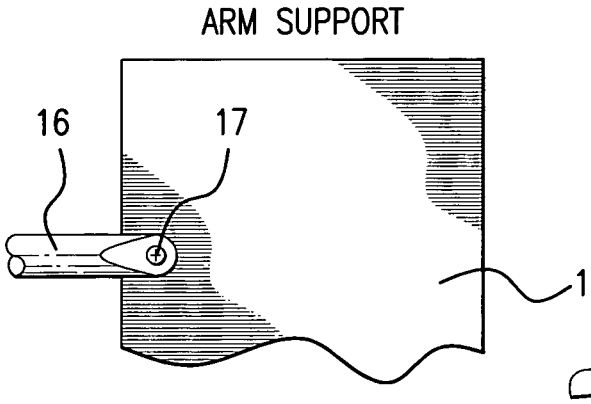
FIG. 2 illustrates various aspects of the arm supports which may be incorporated into the device; specifically FIG. 2(*a*) is an illustration of one arm support of the invention device.
Figure 2B:
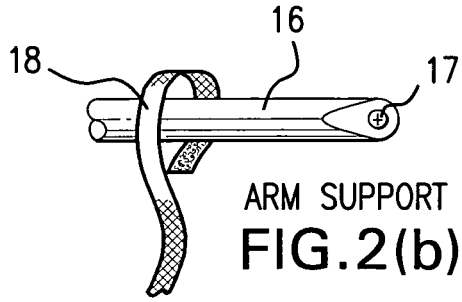
Figure 2C:
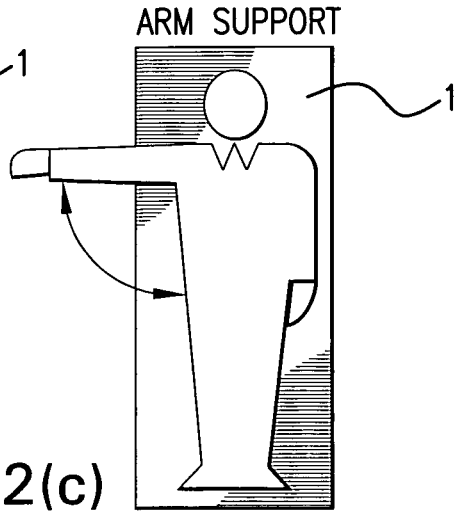
Figure 3A:
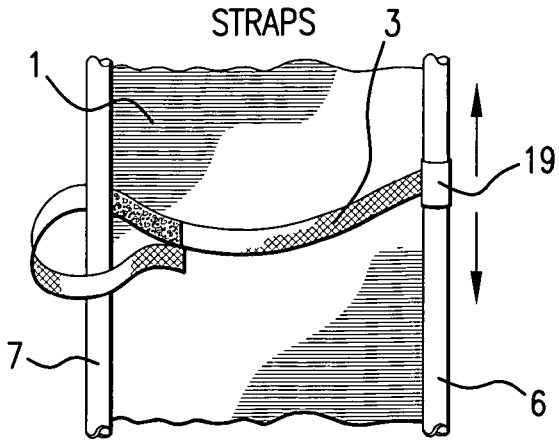
FIG. 3 illustrates various embodiments of the securing straps used in the invention; specifically FIG. 3(*a*) is an illustration showing the strap attached to one side rod and looped around the other side rod.
Figure 3B:
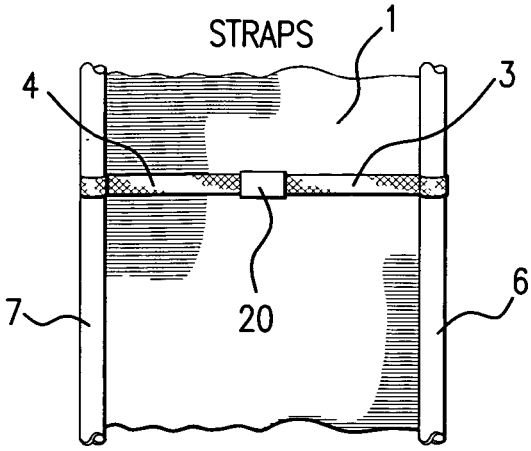
Figure 3C:
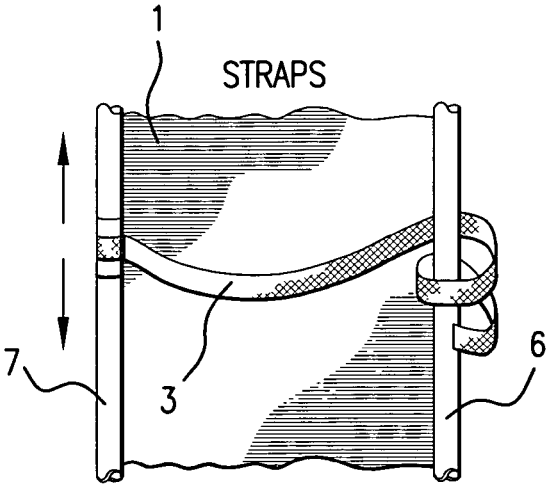
Figure 3D:
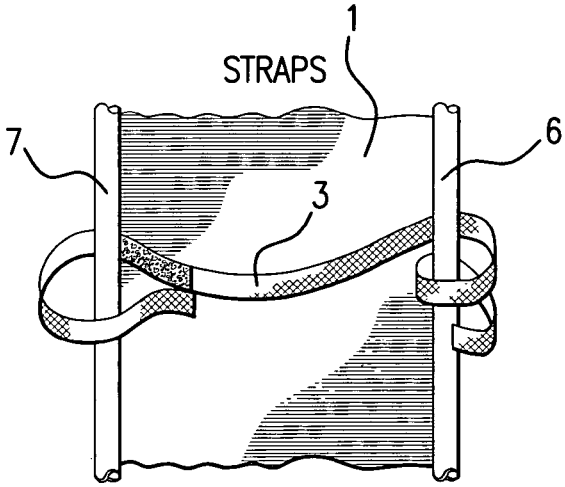

FIGS. 2(*a*), (*b*) and (*c*) illustrate an embodiment of the invention where an arm support 16 is present on the backboard component. The arm support 16 is attached to the backboard component via 17 by welding, plates, screws, a vertically or horizontally adjustable hinge with a rachet stop, a free locking mechanism, or preformed to be part of the backboard device.

The arm support is adjustable to the arms and shoulders of the individual and can be raised and locked in the horizontal and vertical plane to accomplish shoulder/arm abduction in incremental degrees. The axis of rotation of the arm support may be adjusted vertically or horizontally to improve alignment of the shoulder axis with the axis of rotation of the arm support. The arm support 16 can be locked in position at any angle between 0 and 180 degrees. The arm support may also contain a strap 18 to hold the individual's arm in place. The strap may be made of VELCRO®, plastic, metal or fabric. The arm support is used to produce additional forces to augment postural corrective forces. The preferred embodiment of this invention includes a pair of arm supports located at opposite sides of the backboard.

In an alternate embodiment, the arm support may fit into sliding tracks that are located on the backboard component thereby allowing the individual to adjust the arm support vertically or horizontally.

FIGS. 3(*a*), 3(*b*), 3(*c*) and 3(*d*) illustrate various embodiments of the securing straps 3 of the present invention whereby the individual is secured to the device. FIG. 3(*a*) illustrates an embodiment wherein the strap 3 is attached to a side rod 6 via an attachment means. This attachment means is preferably a hook or sliding circular loop or sleeve located at the end of the strap. Strap 3 also loops around side rod 7. An individual pulls the strap 3 which is looped around the side rod 7 and then hooks the strap onto the opposite side rod 6. The individual is then able to adjust the strap to his or her dimensions by either a VELCRO®, winch mechanism or adjustable belt. Furthermore, the individual can adjust the tension in the strap to increase or decrease the applied force. The strap 3 is able to slide up and down the side rods 6 and 7, thereby allowing for infinite variation in the production of support or counter forces.

FIG. 3(*b*) illustrates another embodiment of the invention wherein one strap 3 is attached to a side rod 6 and another strap 4 is attached to the opposite side rod 7. The straps 3 and 4 attach to each other via a retractable seat belt-like mechanism 20 such as a locking or cinching buckle. The cinching buckle can be adjusted incrementally to the dimensions of the individual.

FIGS. 3(*c*) and 3(*d*) illustrate other embodiments of the strap 3 of the present invention. FIG. 3(*c*) shows the strap attached to the side rod 7 preferably via a hook or sliding circular loop or sleeve which then loops around the side rod 6 by either a VELCRO® or winch mechanism with rachet gears. FIG. 3(*d*) shows the strap 3 attached to the side rod 7 preferably by a VELCRO® strap and then looping around the side rod 6 by either a VELCRO® or winch mechanism with rachet gears.

It should be noted that for all the described embodiments, multiple straps may be attached at various locations on the side rods. In a preferred embodiment there are at least five straps which are 4 to 6 inches in width. The usual placement of each of these straps is between the ankles and knees, the knees and the hips, at the waist, at the upper chest/underarms and upon the forehead and or chin. The positions of the straps are all adjustable and depend on the dimensions of the individual.

It should also be noted that the straps may be made of fabric, plastic or metal. The plastic or metal materials may be padded with cushioning.

Figure 4A:
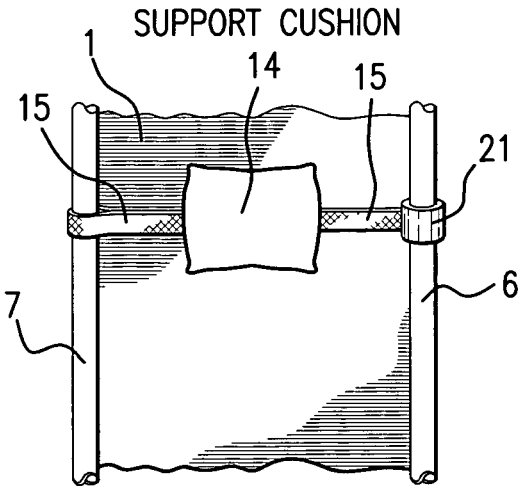
FIGS. 4(*a*), 4(*b*) and 4(*c*) are illustrations of the support cushion and its attachment to the side rods and the backboard component of the invention device.
Figure 4B:
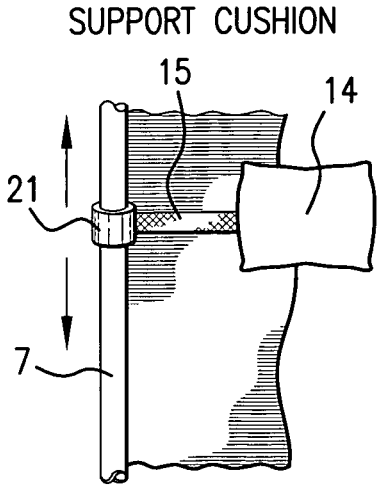
Figure 4C:
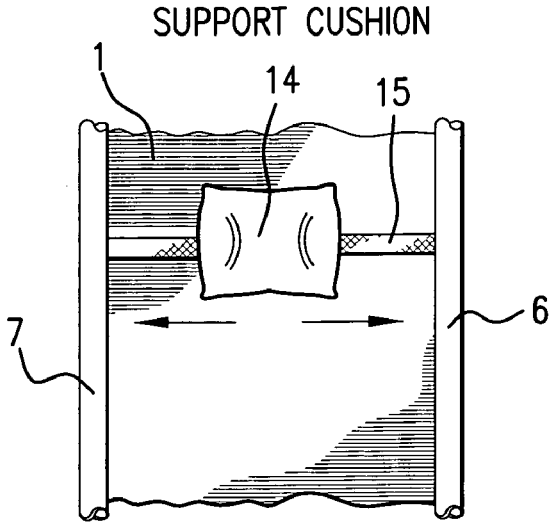

FIGS. 4(*a*), 4(*b*) and 4(*c*) illustrate the support cushion 14 and its attachment to the backboard component 1 via a pair of straps 15. One end of the strap 15 attaches to a side rod 6 and the other end of strap 15 attaches to the opposite side rod 7. The ends of the strap attach to the side rods 6 and 7 preferably via hooks or sliding circular loops or sleeves. The strap 15 can slide up and down the side rods as depicted in FIG. 4(*b*). It should be noted that multiple straps may be attached to the side rods.

The support cushion 14 has belt loops on its posterior side allowing it to be secured to the strap. As a result, in FIG. 4(*c*) the support cushion 14 is able to move along the strap 15 and thereby be positioned (vertically and/or horizontally) at different areas of the backboard component 1. Moreover, the size of the support cushion may be varied to create forces which promote correct posture. The support cushion provides proper postural alignment and lumbar support. It should be noted that there may be multiple support cushions used at various points on the device. In addition, some of the support cushions may also be referred to as lumbar support wedges.

It should be noted that support cushions may alternatively be attached to the backboard component directly via pegs located on the posterior side of the support cushion. These pegs can be plugged or snapped into various positions on the backboard where preformed holes, snaps or rivets are located.

Moreover the support cushions may incorporate a pneumatic device or bladder to enable adjustment when the person is standing in the device. As illustrated in FIG. 1 the backboard component 1 attaches to the foot component 2 via an attachment means 5 thereby allowing the foot component to fold into the backboard component. That attachment means 5 may be selected from the following: hinges, spring action mechanism, rachet stops or sliding parts.

A pair of anti-tilt feet 12 and 13, are located on the bottom side of the foot component 2. The anti-tilt feet extend out from the bottom side of the foot component thereby providing added safety by preventing the device from tipping forward. Moreover, the anti-tilt feet may be adjustable in length to provide secure contact with the floor depending on the position of the foot component. As an alternative, instead of the anti-tilt feet, a wedge can be placed under the foot component to secure the device and prevent it from forward tipping. It should be noted that in another embodiment, the anti-tilt feet may extend from the base of the backboard component and lock to the floor.

A pair of wheels 10 and 11 may be located at the base of the backboard component 1. The wheels allow for the device to be easily transported. In addition, the wheels may lock in position for added safety.

Figure 5A:
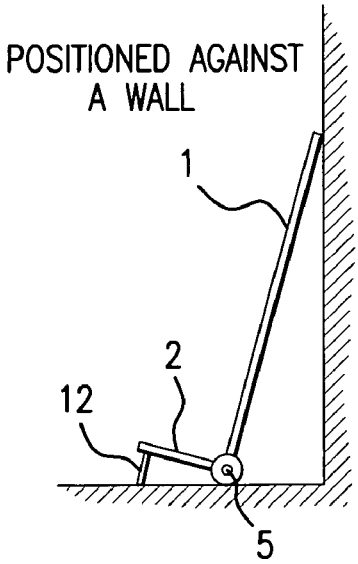
FIG. 5(*a*) is a side view of an embodiment of the device where the backboard component is positioned against a wall and the anti-tilt feet are extending from the foot component.
Figure 5B:
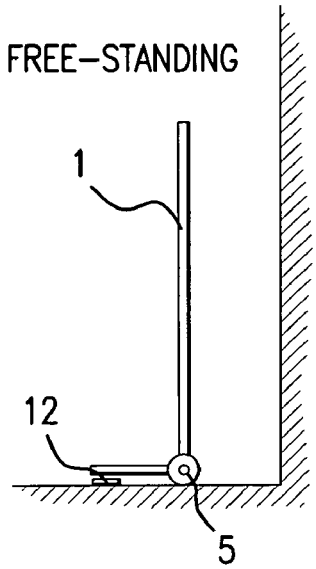
Figure 5C:
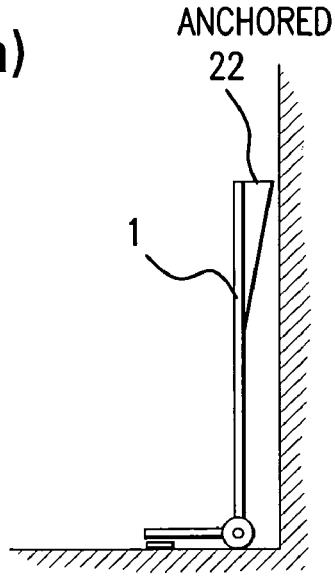

FIG. 5(*a*) is an embodiment of the device where the backboard component 1 is positioned against a wall or a secured support. The backboard component is attached to the foot component 2 via attachment means 5 and the anti-tilt foot 12 is extending from the bottom side of the foot component.

FIG. 5(*b*) is another embodiment of the device where is it is free standing. As illustrated the anti-tilt foot 12 is not used in this embodiment but is folded into the foot component.

FIG. 5(*c*) is another embodiment of the device positioned against a wall, door or doorway with an attachment element 22 which anchors the backboard component 1 to a wall, door or doorway. This attachment element prevents the device from tipping forward or shifting laterally and further stabilizes the device when in use. The attachment element preferably comprises a strap with a hook or bulbous end consisting of a rubber or nylon ball, wedge, etc. to anchor the backboard component to a wall, door or doorway. The bulbous end can be placed over the top of an open door and will cinch or lock the strap in place when the door is closed. Thus the strap-secures the backboard component in place. The strap is adjustable and is attached to the top of the backboard component. It should be noted that in this embodiment the anti-tilt feet may either be extended from the foot component or folded into the foot component.

Figures 6A, 6B, 6C:
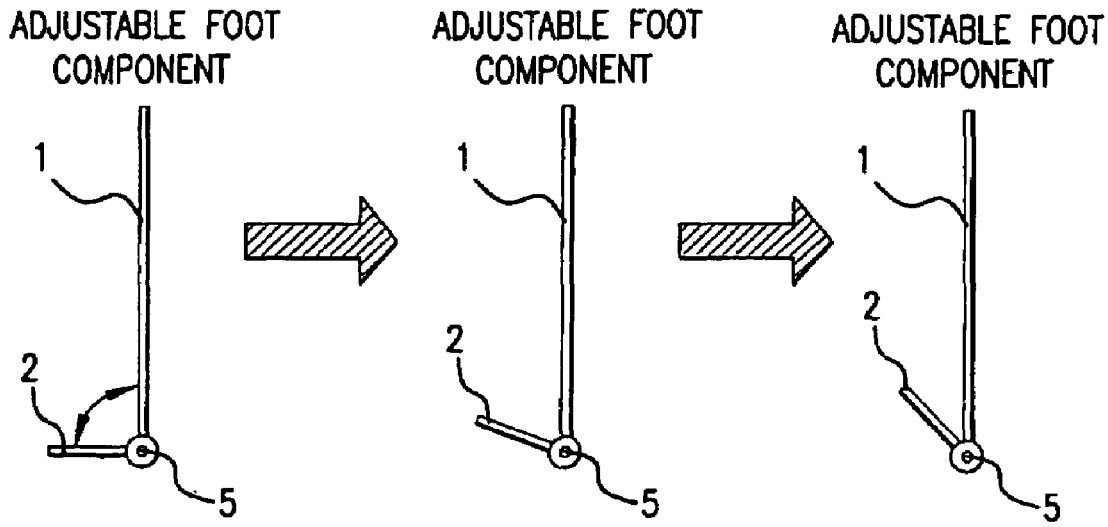
FIGS. 6(*a*), 6(*b*) and 6(*c*) are side views of the invention device showing representative angle adjustments of the foot component.

FIGS. 6(*a*), 6(*b*) and 6(*c*) illustrate a side view of the invention device comprising the backboard component 1, the foot component 2 and the attachment means 5. The attachment means allows the foot component to be incrementally adjusted and locked from angles of 0 to 180 degrees thereby allowing the foot component 2 to fold into the backboard component 1. By allowing the foot component to fold into the backboard component, the device can become more compact and easily portable. Moreover, adjustment of the foot component and straps allow for different tensions to be applied to the calves, specifically the gastrocnemius, soleus and hamstring muscles.

Figures 7A, 7B, 7C:
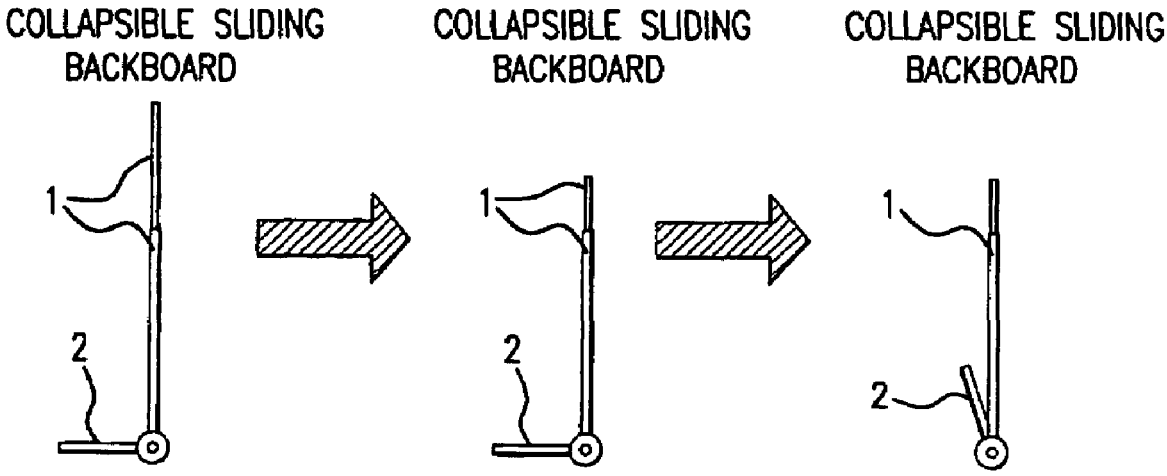
FIGS. 7(*a*), 7(*b*) and 7(*c*) are side views of the invention device where the backboard component is two segments which collapse or slide onto each other.

FIGS. 7(*a*), 7(*b*) and 7(*c*) illustrate an embodiment of the device where the backboard component 1 is comprised of two segments. FIG. 7(*b*) further illustrates the backboard component collapsing or sliding onto itself thereby making the device more compact and portable. FIG. 7(*c*) illustrates the backboard component collapsing onto itself and the foot component folding into the backboard component.

Figure 8A:
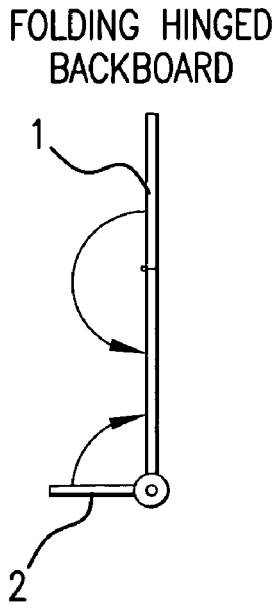
FIGS. 8(*a*) and 8(*b*) are side views of the invention device where the backboard component is comprised of two segments which are hinged and folds onto themselves. The foot component also can fold into the backboard component.
Figure 8B:
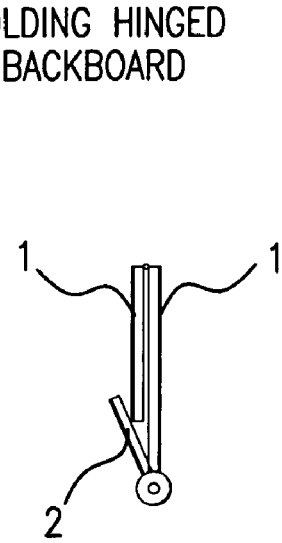

FIGS. 8(*a*) and 8(*b*) represent another embodiment of the device wherein the backboard component is comprised of one segment and folds into itself via a hinge. FIG. 8(*b*) illustrates the backboard component folding into itself and the foot component folding into the backboard component.

Figure 9A:
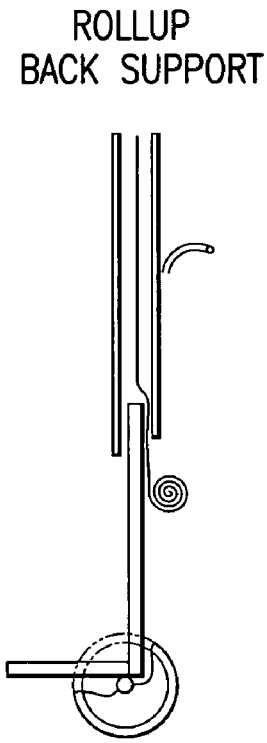
FIG. 9 consists of side views of the invention device where the backboard component can roll out or recoil.
Figure 9B:
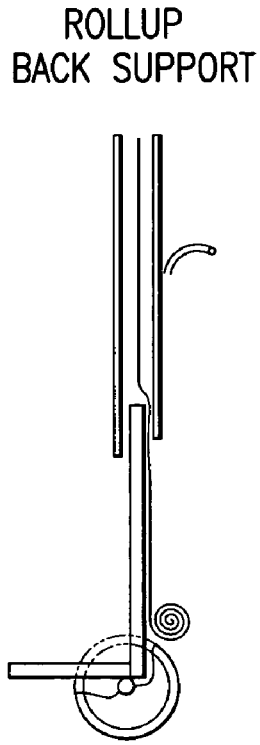
Figure 9C:
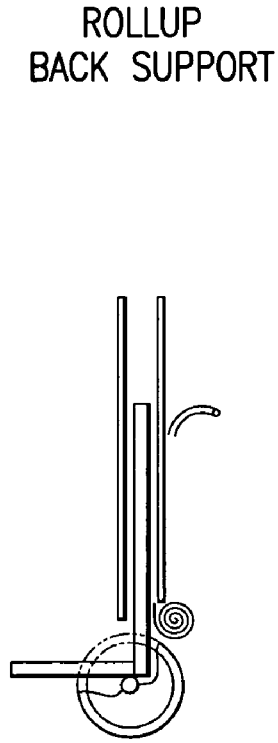
Figure 10A:
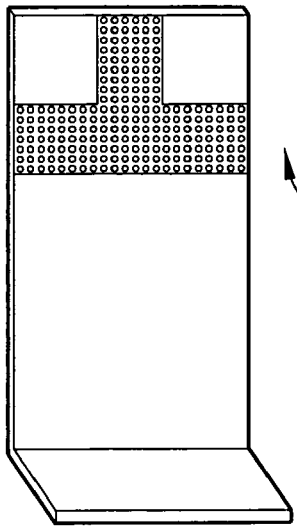
FIG. 10 includes alternate variations of the arm support located on the backboard component.
Figure 10B:
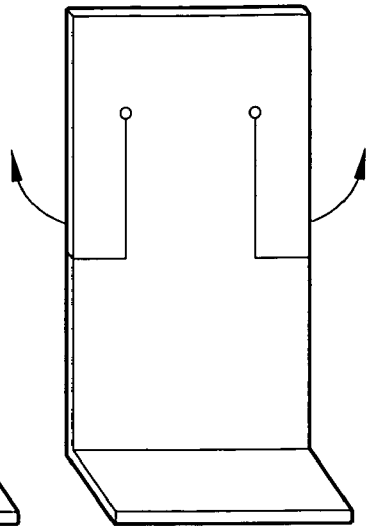
Figure 10C:
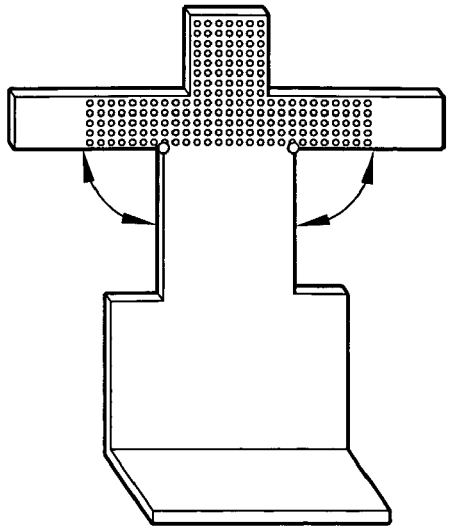
Figure 10D:
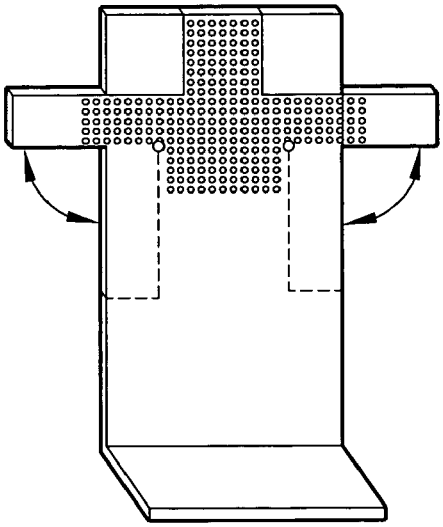
Figure 10E:
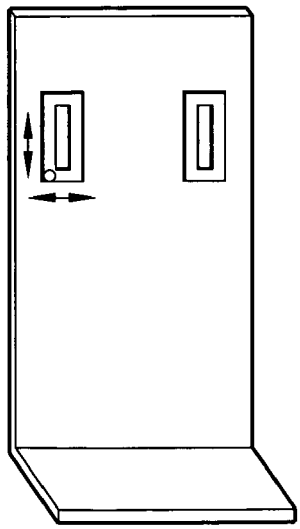
Figure 10F:
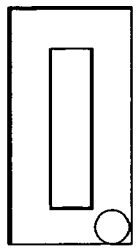
Figure 10G:
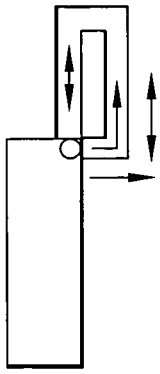
Figure 10H:
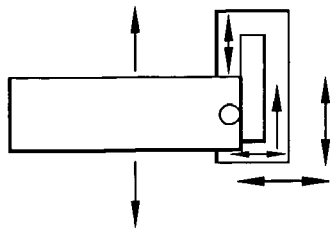

FIG. 9 illustrates various embodiments of the backboard component that are slatted or segmented to allow roll out expansion and recoil.

FIG. 10 illustrates an embodiment of the arm supports hinging out from the backboard component. In addition, in this embodiment the backboard component consists of preformed holes or rivets upon which the support cushions may be attached. Another embodiment of the invention is also depicted where the arm support may fit into a rectangular track that is located on the backboard component thereby allowing the individual to adjust the arm support vertically or horizontally.

Figure 11:
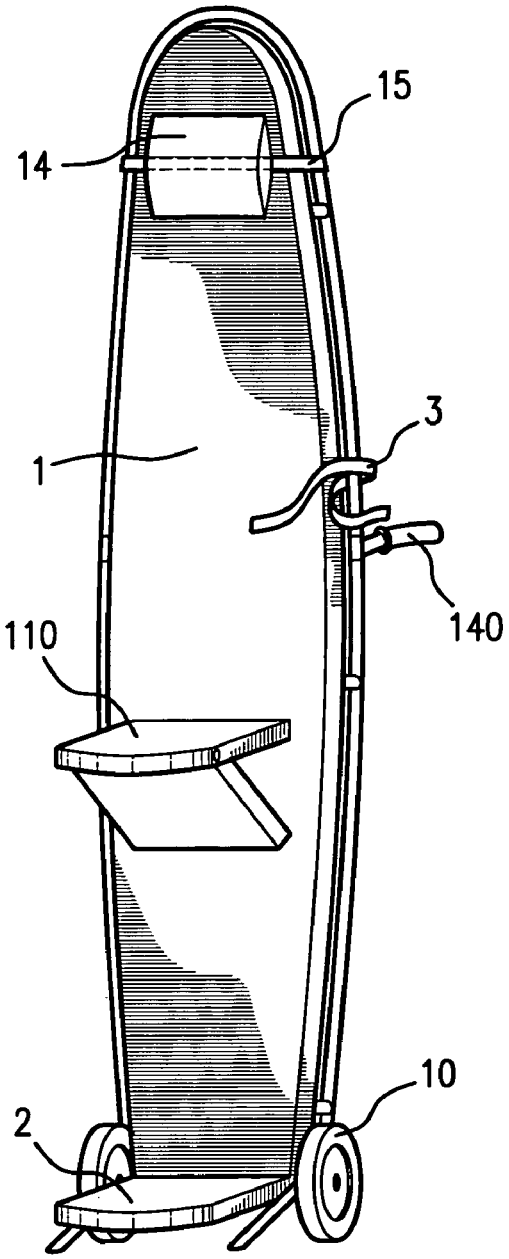
FIG. 11 is an illustration of another embodiment of the portable posture corrector device of the invention.

FIG. 11 is an illustration of another embodiment of the portable posture corrector device of the invention. A seat 110 is included on the backboard component which is foldable. This permits the user to remain in a seated position on the device for resting periods. In addition, a handle 140 is shown for easy transport of the device. In preferred embodiments there maybe a pair of handles.

Figure 12:
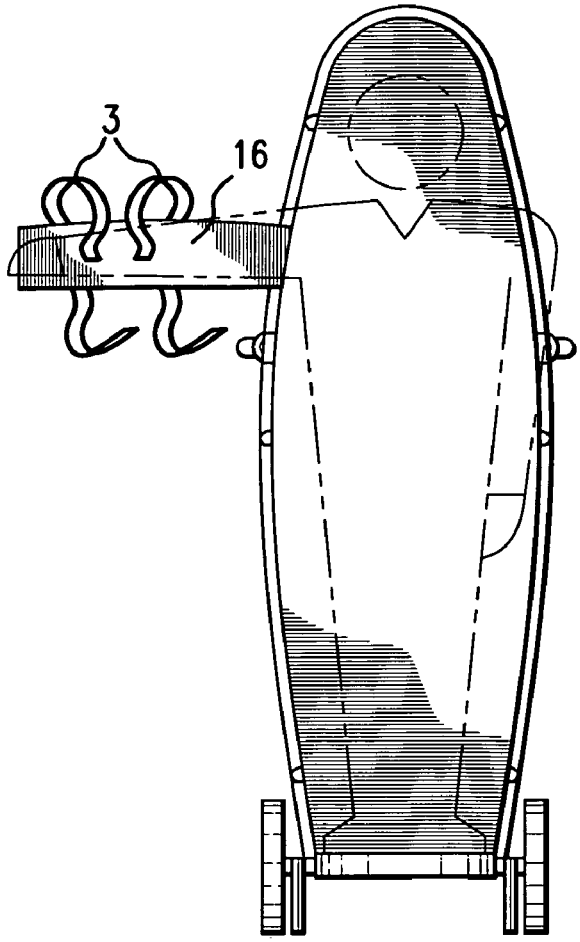
FIG. 12 is another illustration of a person using the arm support.

FIG. 12 is another illustration of a person using the arm support. The arm support 16 is in an extended position which the user's arm is placed upon to rest. The users arm can be strapped in using at least one securing strap 3.

Figure 13:
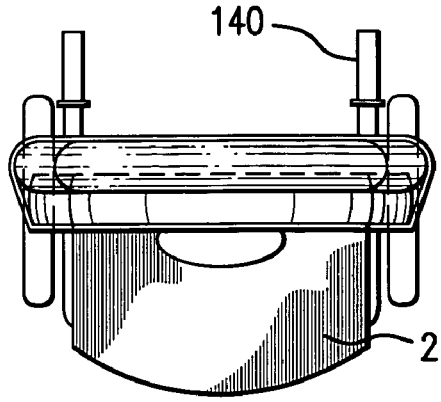
FIG. 13 is a top perspective of the embodiment illustrated in FIG. 11 showing the handles of the device and the foot component in an extended position.

FIG. 13 is a top perspective of the embodiment illustrated in FIG. 11 showing the handles of the device and the foot component in an extended position.

Figure 14A:
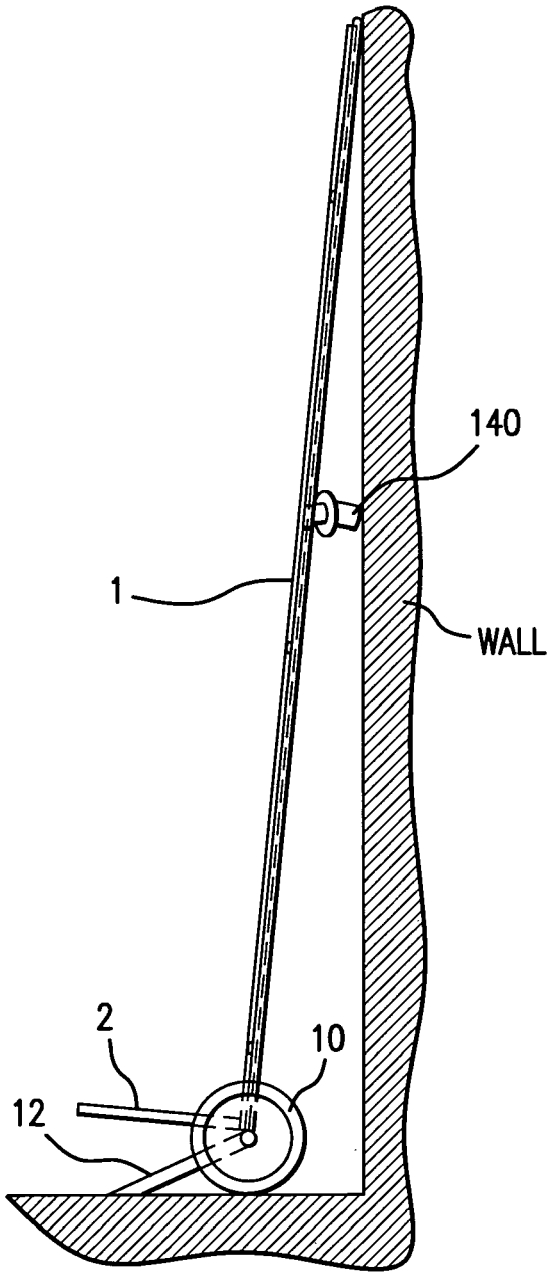
FIGS. 14(*a*) and 14(*b*) illustrate another embodiment of the device positioned against a wall and free-standing, respectively.
Figure 14B:
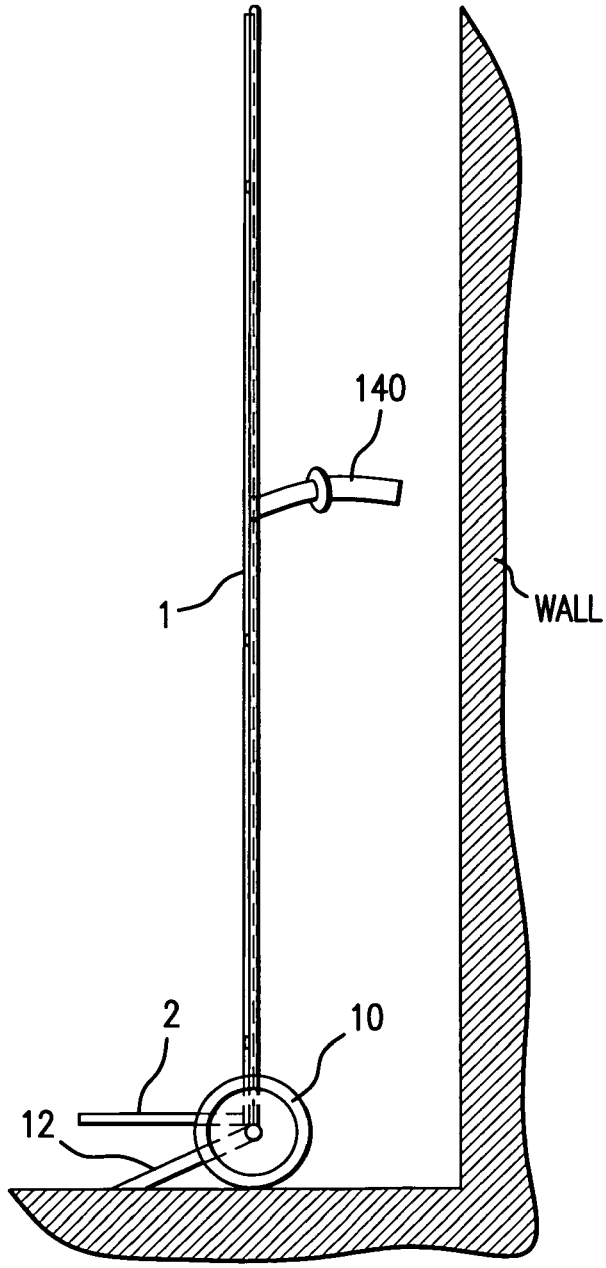

FIGS. 14(*a*) and 14(*b*) illustrate another embodiment of the device positioned against a wall and free-standing, respectively. The handle 140 is also shown in a folded position and open, respectively.

Figure 15A:
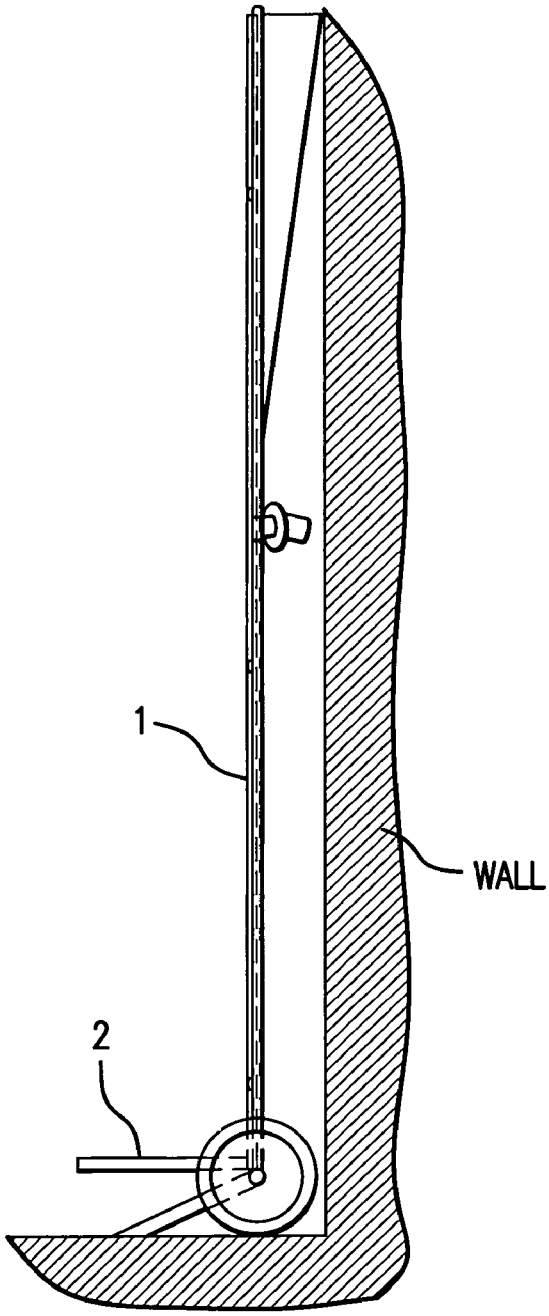
FIG. 15(*a*) illustrates another embodiment of the invention devices secured to the wall.
Figure 15B:
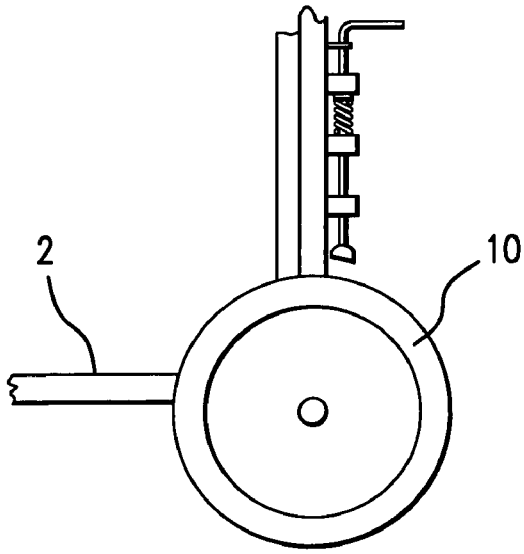
Figure 15C:
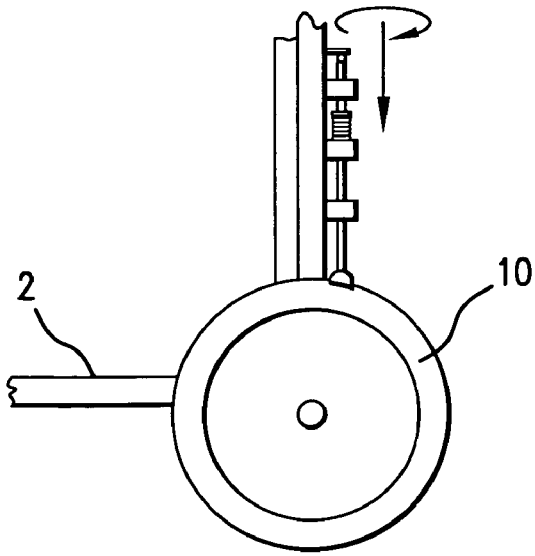
Figure 16A:
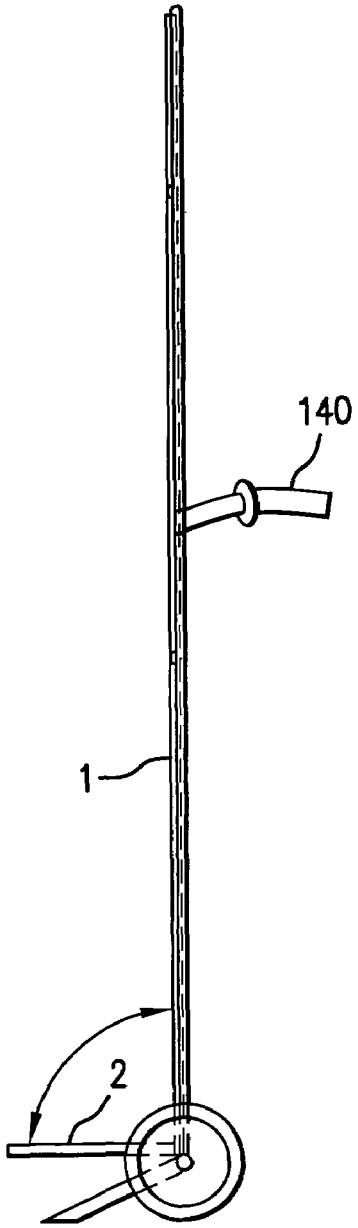
FIGS. 16(*a*), 16(*b*) and 16(*c*) illustrate side views of another embodiment of the invention device showing representative angle adjustments of the foot component.
Figure 16B:
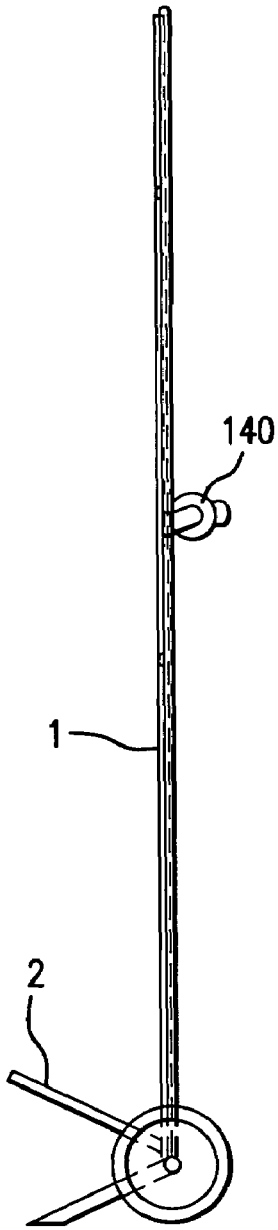
Figure 16C:
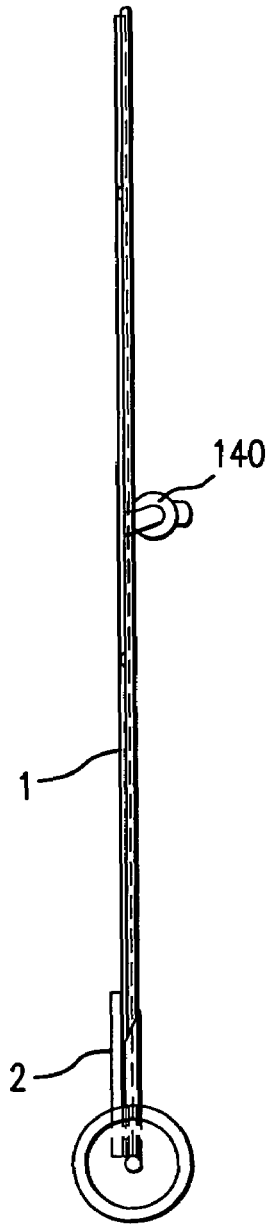
Figure 16D:
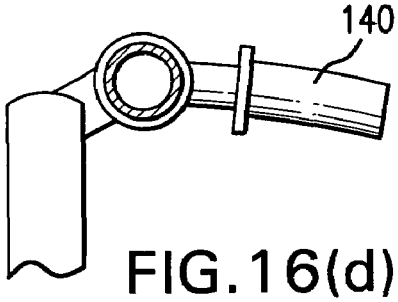
Figure 16E:
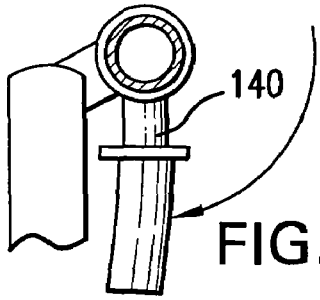

FIG. 15(*a*) illustrates another embodiment of the invention devices secured to the wall; FIGS. 15(*b*) and 15(*c*) illustrate the locking mechanism of the wheels to secure the device in the position desired.

FIGS. 16(*a*), 16(*b*) and 16(*c*) illustrate side views of another embodiment of the invention device showing representative angle adjustments of the foot component; and FIGS. 16(*d*) and 16(*e*) illustrate positioning of the handle component and folding, respectively.

The backboard component and the foot component are comprised of materials selected from the group consisting of aluminum, plastic, steel, light weight metals, wood, fabric, ceramic and/or other composites thereof.

The backboard component of the device is preferably up to 36 inches wide and up to 78 inches long. In the embodiment where the backboard component comprises two segments, the device slides out, folds out or rolls out to a height of about 78 inches and to a width of 36 inches. In preferred embodiments the backboard component is rectangular or oblong. Other shapes may be constructed and the invention device is not limited to these preferred embodiments.

Essentially, the device is vertically wheeled in like a hand truck, positioned and secured for use. Handles are located on the posterior side of the backboard component and they preferably fold onto themselves. An individual stands or is placed in the device by stepping in and onto an adjustable foot component which can move up and down around a hinge to allow for differing tensions to be applied to the calves (gastrocnemius soleus and hamstring muscles). The individual is then secured to the backboard component of the device via at least one strap or a pair of straps.

The device has an adjustable padded back support which the individual leans against to foster proper body mechanics and support of the lumbar spine.

The variable depth and size of the back support can be used to produce or increase counter forces in any area of the posterior body such as the legs and pelvis; the back, specifically the sacrum, cervical, thoracic, or lumbar regions; the shoulders or arms. The device may be used to provide proper biomechanical support or to correct faulty body mechanics.

The benefits of this device include but are not limited to an increase in calcium retention in bones. According to Wolfe's Law, calcium deposition occurs in direct response to weight bearing forces. Moreover, there is an increased maintenance of one's muscular strength due to the muscular response to the stresses of standing.

In addition, the device provides a passive hemodynamic exercise as the body adapts to changes in venous and arterial vessel pressures and vessel diameters in response to positional changes. The increased workload for the heart assists in maintaining and improving heart mass, strength and stroke volume.

The device promotes the normal biomechanics of gait and improves ambulation by providing a graduated foot component to increase gastrocnemius and soleus length and by providing positioning straps to increase hamstring flexibility. As a result of the increase in hamstring and calf flexibility, lower back pains and strains decrease. Moreover, the individual's risk of falling decreases due to an increased ease of ankle dorsiflexion thereby allowing clearance of the foot as it advanced for the next step. Consequently, there are fewer accidents such as tripping over sills, ledges and walking surface protrusions. Ambulatory and standing balance is also improved.

The device also improves posture and balance by promoting normal gait mechanics. In addition, the improved, more erect posture increases an individual's ability to expand their lungs and fill an expanded rib cage and thereby increase oxygenation and breathe easier. Furthermore, the more erect posture promoted by the device, decreases the stress on the back and thereby decreases lower back pain.

The foregoing description of various and preferred embodiments of the present invention has been provided for purposes of illustration only, and it is understood that numerous modifications, variations and alterations may be made without departing from the scope and spirit of the invention as set forth in the following claims.

What is claimed is:

1. A portable, vertical stationary postural correction device used by therapists for physically impaired, disabled or bedridden individuals with postural deficiencies to enable an individual the ability to stand on said device without assistance in an upright position to improve muscle tone and circulation, comprising:

a free-standing backboard component, to support the individual in a standing position, having a front surface and a rear surface, top portion and opposite bottom portion; said backboard component front surface sized and configured adjacent the back portion of an individual's back area; wherein said backboard comprises a single component having two segments such that when not in use said segments are collapsible; an attachment element to stabilize the device in an upright stationary position when the device is in use; wherein said attachment element comprises a flexible strap and hook located on a rear surface of said backboard to anchor the top of said backboard component to a door or wall to prevent the device from tipping forward;

an adjustable foot component positioned transverse to said bottom portion of said blackboard;

a lumbar support wedge positioned on said backboard;

at least one side rod positioned parallel along one side of said backboard component;

and at least one flexible strap attached to said side rod for securing the individual to the device; wherein said backboard component and said foot component are pivotally connected by an attachment means that permits said foot component incremental adjustable movement from 0 to a 90 degree angle to said backboard when in use and permits said foot component to fold into said backboard when not in use providing a compact and portable device that is easily transported and enables individuals with postural deficiencies the ability to stand safely, improve range of motion, decrease muscle contractures and aid in normal skeletal development.

2. The device according to claim 1, further comprising an additional side rod positioned along the opposite side of said backboard component.

3. The device according to claim 1, wherein said attachment means are selected from the group consisting of hinges, spring action mechanism, rachet stops, welds, plates, screws, bolts, sliding or telescoping parts.

4. The device according to claim 1, further comprising a pair of arm supports and/or handles.

5. The device according to claim 4, wherein said arm supports are adjustable and foldable into said backboard.

6. The device according to claim 1 further comprising at least one pair of wheels for transporting the collapsed device.

7. The device according to claim 1, wherein said foot component further comprises a pair of anti-tilt feet which extend out from the bottom side of said foot component and easily fold into said foot component.

8. The device according to claim 2, wherein said strap is attached to one side rod and loops around the other side rod such that the individual is secured on the device.

9. The device according to claim 2, wherein a strap is attached to each of said side rods.

10. The device according to claim 1, further comprising additional straps for securing the individual to the device.

11. The device according to claim 1, wherein said backboard is positioned against a wall.

12. The device according to claim 1, wherein said backboard component and said foot component are comprised of materials selected from the group consisting of aluminum, plastic, steel, light weight metals, wood, fabric, ceramic and/or other composites thereof.

13. The device according to claim 1, wherein said backboard is up to 36 inches wide and up to 78 inches long.

14. The device according to claim 1, further comprising at least one support cushion and/or a fold up seat.

* * * * *